US005164009A

United States Patent [19]

Chandler

[11] Patent Number: 5,164,009

[45] Date of Patent: Nov. 17, 1992

[54] EGG MARKING DEVICE

[76] Inventor: Erie H. Chandler, 1268 Laukahi St., Honolulu, Hi. 96821-1406

[21] Appl. No.: 816,564

[22] Filed: Jan. 3, 1992

[51] Int. Cl.[5] ..... B43L 13/00; B05C 13/02

[52] U.S. Cl. ..... 118/13; 118/76; 118/219; 118/242; 118/218; 118/503; 33/21.1; 33/26

[58] Field of Search ..... 118/13, 211, 216, 218, 118/219, 242, 76, 503; 33/21.1, 21.2, 21.4, 26, 27.01

[56] References Cited

U.S. PATENT DOCUMENTS

| | | | |
|---|---|---|---|
| 425,034 | 4/1890 | Hussey et al. | 118/242 |
| 537,125 | 4/1895 | Rovensky | 33/21.1 |
| 2,270,177 | 1/1942 | Vawryk | 118/503 |
| 2,727,325 | 12/1955 | Jurinic | 118/503 |
| 3,484,797 | 12/1969 | Barnett et al. | 33/21.1 |
| 3,848,564 | 11/1974 | Kull | 118/76 |
| 3,988,834 | 11/1976 | Anderson | 33/21.1 |
| 4,185,389 | 1/1980 | Fudro . | |
| 5,063,871 | 11/1991 | Chambers | 118/13 |

FOREIGN PATENT DOCUMENTS

| | | | |
|---|---|---|---|
| 2602453 | 7/1977 | Fed. Rep. of Germany | 33/21.1 |

*Primary Examiner*—W. Gary Jones
*Assistant Examiner*—Todd J. Burns

[57] ABSTRACT

A device is provided for supporting an egg-shaped article for adjusted angular displacement about its major dimension center axis and guide structure is provided paralleling the axis and having a follower supported therefrom for movement therealong. A marking instrument is supported from the follower for movement along a path extending toward and away from the axis and intersecting therewith in a plane containing the axis and the marking instrument and follower also include structure for selectively supporting the marking instrument from the follower for movement toward and away from the axis in planes paralleling and spaced equally on opposite sides of the first mentioned plane.

10 Claims, 2 Drawing Sheets

EGG MARKING DEVICE

BACKGROUND OF THE INVENTION

1. Field of the Invention

This invention relates to a apparatus for supporting and adjustably rotating an egg to be drawn upon and with structure provided for supporting a drawing instrument in a manner such that uniform designs may be drawn on the associated egg, which designs may include one or more ellipse shaped zones on opposite sides of or spaced about the egg.

2. Description of Related Art

Various different forms of supporting devices for eggs or egg shaped articles heretofore have been provided including some of the general structural and operational features of the instant invention. Examples of these previously known devices are disclosed in U.S. Pat. Nos. 2,270,177, 2,727,325, 3,358,644, 3,484,797, 3,848,564, 3,988,834 and 4,185,389. However, these previously known devices do not include the overall combination of structural and operational features of the instant invention.

SUMMARY OF THE INVENTION

The egg marking apparatus of the instant invention includes a pair of supports mounted from a common base for adjustable shifting toward and away from each other and equipped with mounts adapted to engage corresponding opposite, remote, portions of an egg shaped article therebetween, the mounts being mounted from the corresponding supports for angular displacement relative thereto about an axis extending between the supports. A first of the mounts and the corresponding support include coacting indexing structure whereby the first mount may be secured in adjusted predetermined angularly displaced position relative to the corresponding mount and the second mount is supported from it corresponding support for shifting along the aforementioned axis and is yieldingly biased toward the first mount. In addition, the supports include support structure for supporting a marking instrument therefrom for free shifting along a path intersecting the aforementioned axis at generally right angles relative thereto and disposed in a plane containing the axis. Further, the support structure is movable in a path paralleling the axis and the aforementioned plane and further includes structure for supporting a marking instrument therefrom in planes paralleling and disposed on opposite sides of the first mentioned plane and for movement of the marking instrument along paths generally paralleling the first mentioned path.

The main object of this invention is to provide a convenient device for holding and marking egg shaped articles for the purpose of making decorative markings thereon.

Another object of this invention is to provide an egg marking apparatus which will be capable not only of making the usual marks upon an egg shaped article, both longitudinally of the article and transversely of the article, but also for making elliptical markings on the egg shaped article disposed in planes paralleling a longitudinal diametric plane of the article. Also, the egg marking device may be used to mark numerous symmetrical circular marks about the transverse girth of the egg shaped article supported thereby with the last mentioned marks symmetrically arranged on opposite sides of a plane containing the maximum transverse girth of the egg shaped article.

Yet another object of this invention is to provide an egg marking apparatus including operational features thereof which enable even the infirm and physically disabled persons to successfully provide highly decorative markings on egg shaped articles.

A final object of this invention to be specifically enumerated herein is to provide an egg marking device in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 3:
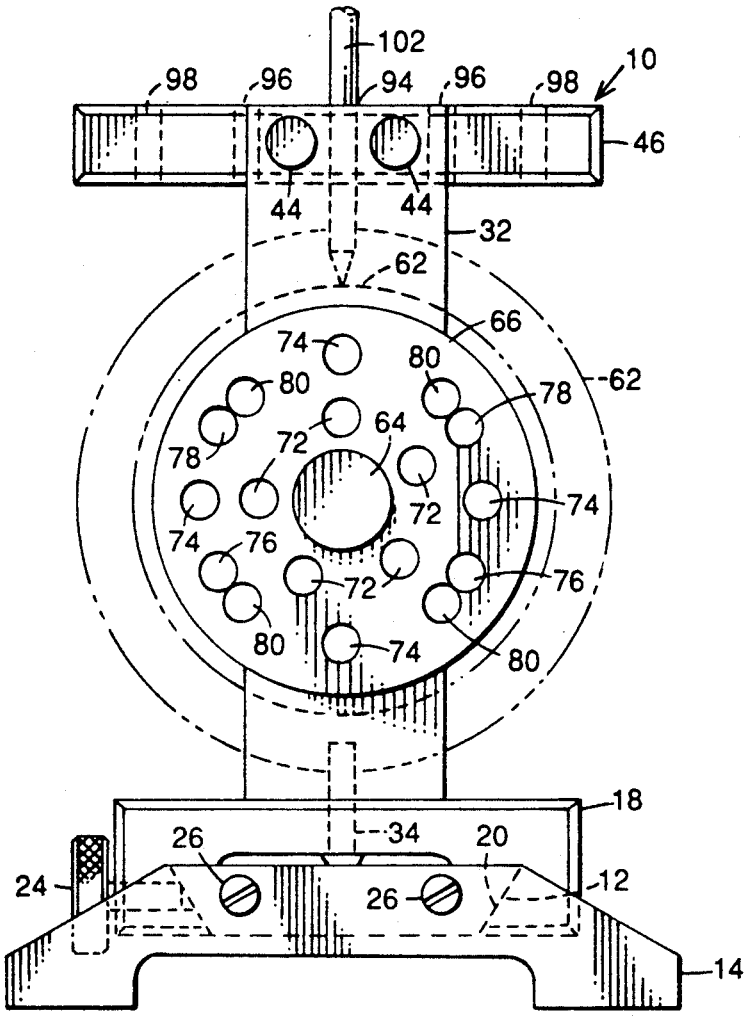
FIG. 3 is an enlarged end elevational view of the marking device as seen from the right side of FIG. 1.
Figure 4:
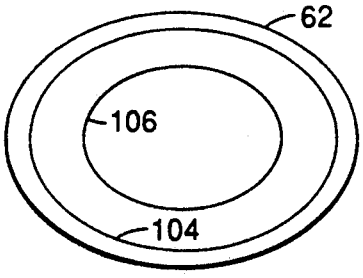
FIG. 4 is a side elevational view of an egg illustrating the manner in which ellipses may be drawn on opposite sides of an egg.

Referring now more specifically to the drawings the numeral 10 generally designates the egg marking device of the instant invention. The device 10 includes a horizontally elongated base 12 having opposite end support feet 14 and it may be seen from FIG. 3 of the drawings that the base 12 is dovetail-shaped in transverse cross section.

Mounted from the base 12 for sliding movement therealong are first and second mounts 16 and 18 and each mount includes downwardly opening groove formed therethrough which also is dovetailed shaped in cross section and snugly and slidably receives the base 12 therethrough, the mount 16 including a set screw 22 and the mount 18 including a set screw 24 whereby the mounts 16 and 18 may be releasably retained in adjusted shifted position along the base 12. The mounts 16 and 18 may be mounted upon the base 12 or removed therefrom merely by removing one of the support feet 14, the support feet 14 being releasably secured to opposite ends of the base 12 through the utilization of fasteners 26.

The mount 16 supports the lower end of an upstanding elongated support 28 therefrom through the utilization of a fastener 30 and the mount 18 supports the lower end of a second upstanding support 32 therefrom through the utilization of a fastener 34.

The supports 28 and 32 include aligned horizontal bores 36 and 38 formed therethrough as well as pairs of side-by-side and aligned apertures 40 and 42 formed therethrough adjacent the upper extremities thereof. The pairs apertures 40 and 42 receive a pair of guide rods 44 therethrough and a marking instrument supporting block 46 has parallel bores 48 formed therethrough by which the block 46 is slidably mounted on those portions of the rods 44 extending between the supports 28 and 32.

The rods 44 are contained in vertical parallel planes equally spaced on opposite sides of a vertical plane containing the bores 36 and 38.

The threaded shank 50 of a bolt 52 is rotatably received through the bore 38 and is threadedly engaged and bottomed within a threaded blind bore 54 formed in a support block 56. The support block 56 includes a recess 58 formed in the end thereof remote from the blind bore 54 and the recess 58 includes a cupped cushion member 60 secured therein for gently frictionally engaging and supporting one end of an egg 62 to be marked. The end of the bolt remote from the free end of the shank 52 includes a knurled head 64 and a disc 66 is attached to the underside of the head 64 in any convenient manner. The head and disc 64 are disposed on one side of the support 32 and the support block 56 is disposed on the other side of the support 32 adjacent the support 28, the support block 56, bolt 52, head 64 and disc 66 all being secured together for simultaneous rotation relative to the support 32.

The support 32 includes a pair of upper and lower blind bores 68 and 70 opening outwardly of the side of the support 32 remote from the support 28 at predetermined elevated positions above the bore 38 and the disc 66 includes a outer peripheral set of bores 72 formed therethrough registerable with the blind bore 68 and an inner peripheral set of bores formed therethrough registerable with the blind bore 70. The inner peripheral bores include five bores 72 spaced equally about and from the bore 38 and the outer peripheral set of bores includes a set of four bores 74, a set of two additional bores 76 which combine with the uppermost bore 74 in FIG. 3 to define a set of three equally peripherally spaced bores, a set of bores 78 which combine with the bores 76 and the uppermost and lowermost bores 74 in FIG. 3 to define a set of six equally peripherally spaced bores and a set of bores 80 which combine with the bores 74 to define eight peripherally spaced bores.

An indexing pin 82 is provided and selectively receivable through any one of the bores 74, 76, 78 and 80 and within the blind bore 68 to maintain the disc 66 in proper indexed position. Also, the indexing pin may be passed through any one of the bores 80 and seated in the blind bore 70 to maintain the disc 66 in any one of the five indexed positions thereof determined by the bores 72.

Figure 1:
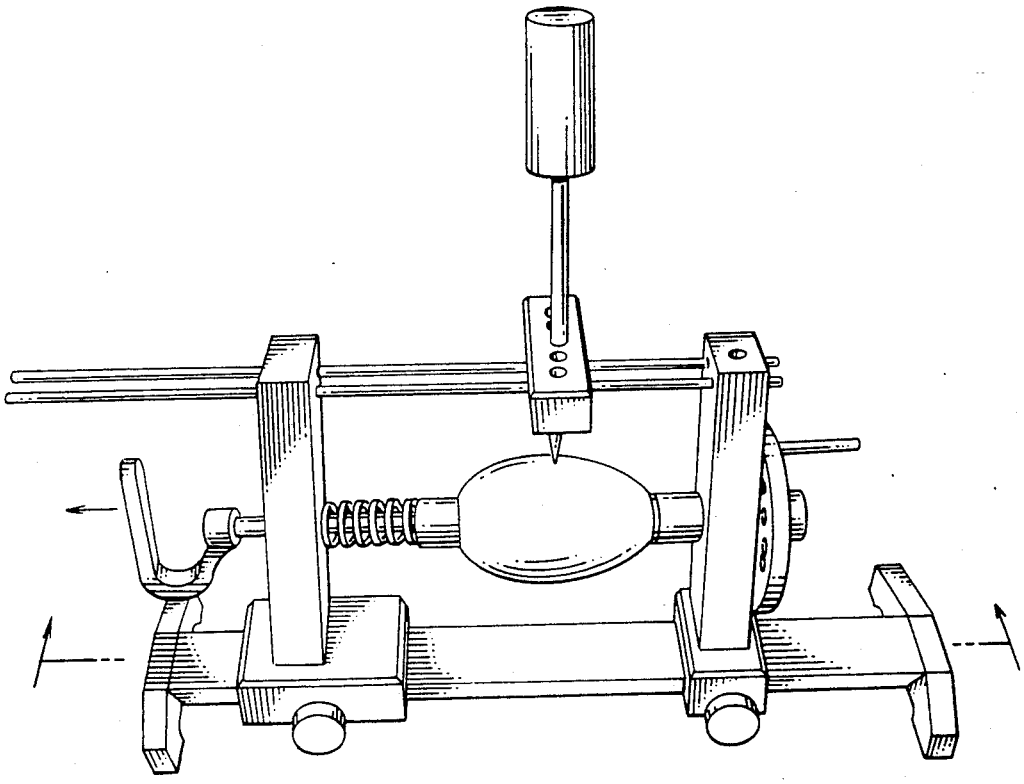
FIG. 1 is a top front perspective view of an egg marking device constructed in accordance with the present invention.
Figure 2:
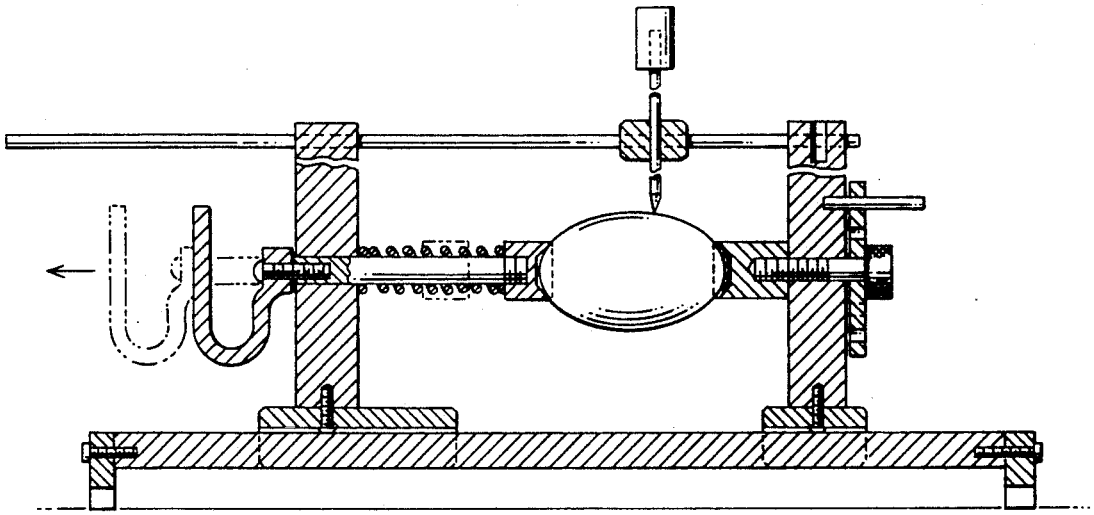
FIG. 2 is an enlarged longitudinal vertical sectional view taken substantially upon the plane indicated by the section line 2—2 of FIG. 1, with portions of the upper ends of the support standards being broken away.

With attention now to the left hand portion of FIG. 2, it may be seen that a rod 84 is slidably and rotatably received through the bore 36. The end of the rod 84 adjacent the support block 56 has a similar support block 86 mounted thereon and a compression spring 88 is disposed about the rod 84 between the block 86 and the side of the support 28 adjacent the support 32 and thus biases the rod 84 to the right as viewed in FIG. 2. The end of the rod 84 remote from the support block 86 has a rotating and pulling handle 90 mounted thereon through the utilization of a fastener 92 on the side of the support 28 remote from the support 32. The handle 90 may be used to pull the rod 84 to the left against the biasing action of the spring 88.

The marking instrument support block 46 includes a center vertical bore 94 formed therethrough whose longitudinal center axis lies in a vertical plane also containing the center axis of the bores 36 and 38 and the block additionally includes a first pair of laterally offset bores 96 spaced along the support block 46 equal distances on opposite sides of the last mentioned plane as well as a second pair of laterally spaced bores 98 formed therethrough spaced further away from the last mentioned plane.

In operation, after the supports have been properly positioned along the base 12 according to the general size of the egg 62 to be marked, the handle 90 is pulled to the left as viewed in FIG. 2 of the drawings, the egg 62 is placed between the support blocks 56 and 86 and the handle 90 is then allowed to slowly return to the right as view in FIG. 2 of the drawings under the biasing action of the spring 88 until the blocks 56 and 86 firmly compressibly engage the egg 62 therebetween for support of the egg from the device 10.

Figure 5:
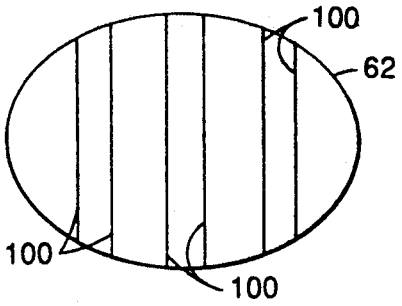
FIG. 5 is a side elevational view of an egg illustrating the manner in which circumferential markings may be drawn on an egg.

If circular markings such as those illustrated at 100 in FIG. 5 are to be made on the egg 62, the pin 82 may be removed, a weighted marking instrument 102 may be placed in the center bore 94 and the marking instrument supporting block 46 may be positioned along the rods 44 as desired and stationarily held in position. Then, the head 64 may be slowly rotated in order to cause the egg 62 to be angularly displaced about its major axis in order to form one of the circular markings 100. Of course, similar markings 100 may be successively formed along the length of the egg 62 merely by shifting the positioning of the marking instrument supporting block 46 along the rods 44.

If, on the other hand, elliptical markings 104 and 106 are to be made on the egg 62, the marking instrument is first placed in one of the bores 96 and the mounting instrument supporting block is shifted along the rods 44, with the indexing pin 82 in the position thereof illustrated in FIG. 2, in order to form the upper portion of the marking 104. Then, the marking instrument 102 is removed, the head 64 is turned 180 degrees and the indexing pin is used in the diametrically opposite bore 74 to index the egg in a 180 degree rotated position. Then, the marking instrument 102 is placed in the other bore 96 and the marking instrument supporting block 46 is again moved along the rods 44 in order to complete the elliptical marking 104. Thereafter, if the elliptical marking 106 is to be formed, the marking instrument 102 is placed in the adjacent bore 98 in order to thereafter mark the upper portion of the marking 106, the egg 62 is then indexed in 180 rotated position and the marking instrument 102 is placed in the other bore 98 in order that the remainder of the marking 106 may be completed. Of course, the mounting instrument supporting block 46 may have additional pairs of laterally offset bores formed therethrough corresponding to the bores 94 and 96.

It also may be understood that markings lying along major axis diametric planes of the egg 62 may be made by utilizing the marking instrument 102 in the center bore 94, sliding the mounting instrument support block back and forth along the rods 44 and selectively indexing the disc 66 through the utilization of selected bores in the disc 66 and either the blind bore 68 or the blind bore 70 in conjunction with the indexing pin 82. Here again, the disc 66 could be provided with additional sets of bores and there could even be an additional blind bore corresponding to the blind bores 68 and 70 formed in the support 32 (possibly below the bore 38).

It is proposed that each set of bores 72, 74, 76 and 78 will be color coded in some manner on the disc 66 so as to avoid confusion between the different sets of bores formed through the disc 66.

The device 10 is clearly constructed in a manner whereby minor adjustments in the size of the egg 62 to be marked may be compensated for by the rod 84. In addition, major adjustments for compensating for major differences in egg size may be accomplished by adjusting one or both of the supports 28 and 32 along the base 12. Of course, the height of the bores 36 and 38 above the base 12 and the height of the bars 44 above the bores 36 and 38 determines the maximum size of egg which may be marked by the device 10.

Finally, unusual oval or elliptical markings similar to the markings 104 and 106 may be made upon the egg 62 by first making the ovals 104 and 106 and thereafter indexing the discs 66 as desired and then making additional markings 104 and 106, the result being very unusual egg markings.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A device supporting and decorating egg-shaped articles comprising: an elongated base, first and second generally parallel, elongated supports having first ends mounted on said base, and having second ends projecting outwardly from one side of said base, and substantially normal to said base, at least one of said supports being adjustable along the length of said base to vary the spacing between said supports; first and second mounts carried by said first and second supports, said mounts capable of angular displacement about an axis extending between said supports, sand mounts further include egg end receiving seat means adapted to frictionally grip and support the ends of said egg-shaped article disposed between said mounts, one of said mounts and its corresponding support includes indexing means operative to releasably index said one mount in selected predetermined angularly displaced positions about said axis relative to said corresponding support, the other of said mounts being supported on its corresponding support, and having biasing means for biasing said other mount toward said one mount for a snug frictional fit of said egg-shaped article between said mounts; elongated guide means mounted on and extending between said second ends of said supports; a marking instrument support block mounted on said guide means for guided movement along the length of said guide means; and a marking instrument, said marking instrument support block having means to mount said marking instrument therein for guided movement of said marking instrument in a first plane which includes said axis and is substantially perpendicular to said base, said marking instrument support block further includes means to mount said marking instrument therein for guided movement in one of a first pair of planes, each individual plane of said first pair of planes being parallel to, spaced equally from and on opposite sides of said first plane.

2. The device of claim 1 wherein said marking instrument support block further includes means for mounting said marking instrument for guided movement in a second pair of planes spaced equally on opposite sides of and parallel to said first plane, and with the spacing of said second pair of planes from said first plane being greater than the spacing of said first pair of planes from said first plane.

3. The device of claim 1 wherein the other support is also adjustable along the length of said base.

4. The device of claim 1 wherein said indexing means includes means operative to index said one mount in three equally angularly displaced positions about said axis.

5. The device of claim 4 wherein said indexing means also includes means operative to index said mount in four equally angularly displaced positions about said axis.

6. The device of claim 5 wherein said indexing means further includes means for indexing said one mount in five equally angularly displaced positions about said axis.

7. The device of claim 6 wherein said indexing means also includes means operative to index said one mount in six equally angularly displaced positions about said axis.

8. The device of claim 7 wherein said indexing means includes means operative to index said one mount in eight equally angularly displaced positions about said axis relative to the corresponding support.

9. The device of claim 8 wherein said marking instrument support block further includes means for mounting said marking instrument for guided movement in a second pair of planes spaced equally on opposite sides of and parallel to said first plane, and with the spacing of said second pair of planes from said first plane being greater than the spacing of said first pair of planes from said first plane.

10. The device of claim 9 wherein the other support is also adjustable along the length of said base.

* * * * *